United States Patent [19]

Dinger

[11] Patent Number: 4,565,494

[45] Date of Patent: Jan. 21, 1986

[54] FAN BLADE SUPPORT RING

[75] Inventor: Nelson E. Dinger, Erie, Pa.

[73] Assignee: Huber Reversible Fan, Inc., Erie, Pa.

[21] Appl. No.: 668,100

[22] Filed: Nov. 5, 1984

[51] Int. Cl.[4] ..... F04D 29/36

[52] U.S. Cl. ..... 416/206

[58] Field of Search ..... 416/206, 205, 207, 208, 416/209

[56] References Cited

U.S. PATENT DOCUMENTS

| | | | |
|---|---|---|---|
| 1,479,895 | 1/1924 | Colby | 416/206 |
| 3,026,943 | 3/1962 | Huber | 416/206 |
| 4,140,435 | 2/1979 | Huber | 416/206 |
| 4,396,352 | 8/1983 | Pearce | 416/206 |

FOREIGN PATENT DOCUMENTS

| | | | |
|---|---|---|---|
| 0546799 | 6/1930 | Fed. Rep. of Germany | 416/207 |

*Primary Examiner*—Robert E. Garrett

*Assistant Examiner*—H. Edward Li

*Attorney, Agent, or Firm*—Charles L. Lovercheck; Wayne L. Lovercheck; Dale R. Lovercheck

[57] ABSTRACT

A cooling fan and hub support for a vehicle with reversible blades is disclosed. The fan has a hub support comprising an outer ring having inwardly extending projections and an inwardly directed flange. Each blade has a stem received in a hole in one of the projections. An inner retaining ring which has outwardly extending projections is supported concentric with the outer ring. A helical spring is received in each of the projections and extends into a blind hole in each stem and the inner end of the spring rests on a retaining ring. The outer ring has spaced holes for attaching it to an engine shaft. The retaining ring has convolutions which curve outwardly around each of the spaced holes and have an arcuate circumferential part that supports each inner end of a spring.

4 Claims, 4 Drawing Figures

FAN BLADE SUPPORT RING

REFERENCE TO PRIOR ART

The U.S. Pat. No. 4,140,435 to Huber and the prior art references cited therein and U.S. Pat. No. 4,396,352 to Pearce are the closest art of which Applicant is ware. None of these references show a blade support ring like Applicant discloses herein.

BACKGROUND OF INVENTION

This invention is an improvement over the reversible fan shown U.S. Pat. No. 4,140,435 issued to Herman Huber. In U.S. Pat. No. 4,140,435 a ring supports the inside of the blades is in the four of a circle. The ring is made large enough to provide access to the form mounting bolts. This results in restricted space for springs. In the present invention, the ring is formed of a convoluted shape. Each convolution circumvents a hole in the mounting flange so that the mounting studs can be readily accessible for assembly and disassembly. The springs are supported on a radially extending pins attached to the ring between the convolutions and can therefore be made substantially larger than the springs in U.S. Pat. No. 4,140,435.

OBJECTS OF THE INVENTION

It is an object of the invention to provide an improved part of a reversible fan.

Another object of the invention is to provide an improved blade support ring for supporting the base of the fan.

Another object of the invention is to provide a part of a reversible fan that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWING

Figure 1:
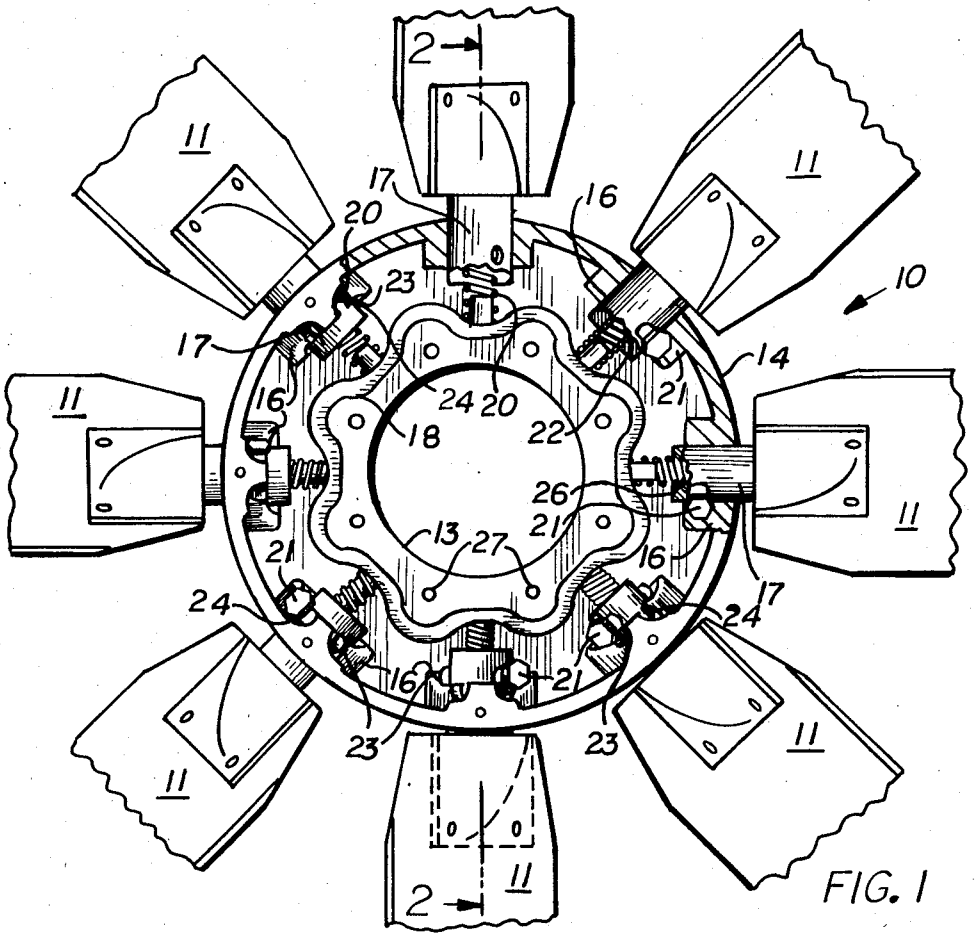
FIG. 1 is a front view of the fan and improved blade support according to the invention.
Figure 2:
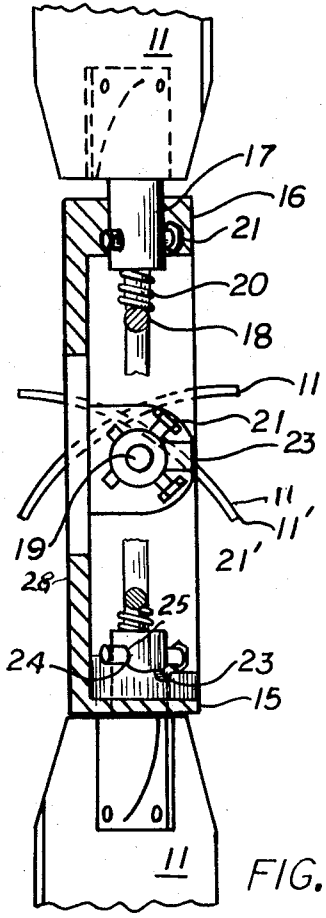
FIG. 2 is a longitudinal cross sectional view of the fan and improved blade support taken on line 2—2 of FIG. 1.
Figure 4:
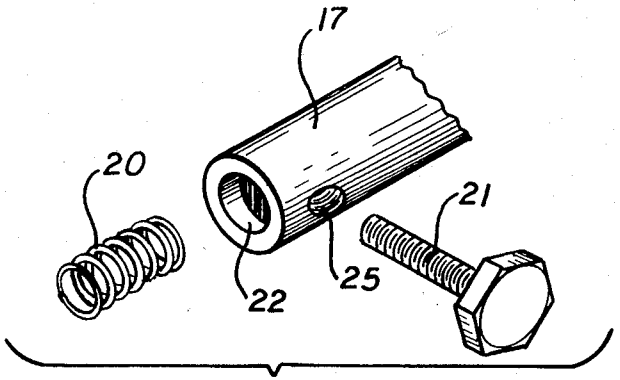
FIG. 4 is an exploded view of the blade stem assembly.
Figure 3:
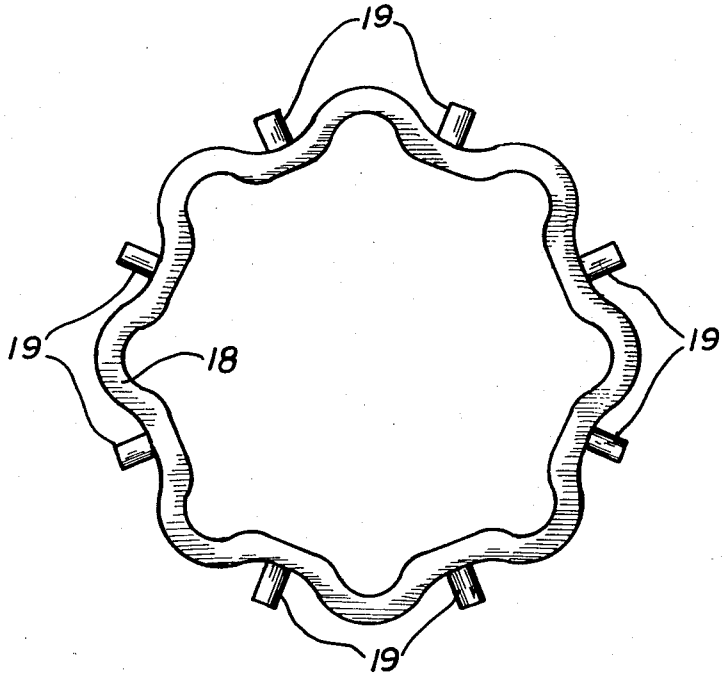
FIG. 3 is a view of the spring supporting ring according to the invention.

Now with more particular reference to the drawings. The fan is generally indicated at 10 having reversible blades 11 which may be moved from a first position to a second position shown in FIG. 2. The fan hub has an outer ring indicated generally at 14 and has an inner flange 28, a central shaft receiving opening 13 surrounded by holes 27 in inner flange 28 for clamping the hub to shaft of an engine in a manner familiar to those skilled in the art. The outer ring 14 has a peripheral axially extending outer flange 15 as shown in FIG. 2, and a plurality of inwardly extending nipples 16 welded to and supported on the ring. The nipples 16 each have a bore 26 that receives the stem 17 of a blade 11. The stem 17 of each blade has a blind hole 22 formed in its inner end. Each blind hole 22 receives an outer end of one of the springs 20. The springs 20 each have their inner end resting on the inner retaining ring 18 which has the spaced pins 19 supported on the ring. The pins 19 retain the springs 20 in position and form a support for them. The inner locking ring 18 is held in place by the springs 20. Each nipple 16 has diametrically extending notches 23 and 24 which can receive one end of the threaded studs 21. Threaded studs 21 are each received in a transverse hole 25 on the inner end of the stems 17.

The springs 20 urge the stem 17 outward so that the threaded studs 21 rest in one of the notches 23 or 24. When the threaded stud 21 is resting in the notch 23, the blade 11 is held in a forward operating position. When the threaded stud 21 is resting in notch 24, the blade 11 is held in the second operating position 11'. The blades on the fan can be supported in a first position to draw the cooling air through the radiator, thereby heating it and driving it back over the operator of the tractor to keep him warm. If it is desired to change the flow of air forward to a second operating position, for example, the operator will grasp each blade 11 individually and force it inwardly against the force of spring 20. This will move the stud 21 out of the notch 23 and the end of the nipple 16. The operator can then rotate the fan blade to the position of the notch 24.

The inner retaining ring 18 has symmetrically spaced arcuate convolutions each curving around an area surrounding one of the holes 27 in the outer flange 15 providing access to holes 27 in the flange.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A fan, having an outer ring having a circumferentially spaced radially extending holes, blades, each having a stem on one end thereof, one said stem extending through each of said holes, an inner ring, springs, each having an outer end and and inner end, circumferentially spaced fan support means on said outer ring to support said fan on an engine, said inner ring having a plurality of symmetrically spaced outwardly curving parts, a spring support portion joining each said outwardly curved part and spaced inwardly from said outwardly curving part, said inner end of each said spring resting on each said spring supporting portion of said inner ring and its outer end engaging a said stem urging said blade attached to said stem outwardly, means on said inner end of each said stem limiting the outward movement of said stem and means to retain said stem in a predetermined positions of rotation.

2. The fan recited in claim 1 wherein one said means to support said outer ring on said engine comprises:

an inwardly radially extending flange ring attached to said outer ring and spaced axially extending openings in said flange ring adapted to receive studs for attaching said fan to an engine.

3. The fan recited in claim 2 wherein said each said axially extending opening is disposed generally at the center of curvature of a said outwardly curving portion on said inner ring thereby providing access to said axially extending opening.

4. The fan recited in claim 1 wherein said limit means comprises a plurality of studs, each said stud extending diametrically through the inner end of a set hub and adapted to threadably engage the inner end of a said boss.

* * * * *